US005584421A

United States Patent [19]

Blanchard et al.

[11] Patent Number: 5,584,421

[45] Date of Patent: Dec. 17, 1996

[54] SELF-CENTERING HANGER ASSEMBLY

[75] Inventors: Russell O. Blanchard, Zeeland; John H. Batts, Grand Rapids, both of Mich.

[73] Assignee: Batts, Inc., Zeeland, Mich.

[21] Appl. No.: 462,645

[22] Filed: Jun. 5, 1995

[51] Int. Cl.[6] ..... A47G 25/40; A47G 25/44; A47G 25/48

[52] U.S. Cl. ..... 223/94; 223/89; 223/85

[58] Field of Search ..... 223/85, 89, 92, 223/94; D6/324

[56] References Cited

U.S. PATENT DOCUMENTS

| | | | |
|---|---|---|---|
| 1,922,858 | 8/1933 | Page | 223/67 |
| 2,332,203 | 10/1943 | Chidley | 223/95 |
| 2,793,799 | 5/1957 | Frank et al. | 223/95 |
| 3,024,954 | 3/1962 | Michlin | 223/95 |
| 3,070,269 | 12/1962 | Zuckerman | 223/88 |
| 5,102,019 | 4/1992 | Lam | 223/89 |
| 5,397,038 | 3/1995 | Hunt | 223/89 |

*Primary Examiner*—Bibhu Mohanty
*Attorney, Agent, or Firm*—Baker & McKenzie

[57] ABSTRACT

A garment hanger which can be manufactured from inexpensive materials on a mass production basis which is extendable and contractible as many times as desired by the user throughout its useful life by a camming system formed by the interaction of cam drivers on each of two arms which engage with a cam follower carried in a central housing, the components being quickly and easily assembled but, when assembled, virtually impossible to disassemble.

13 Claims, 4 Drawing Sheets

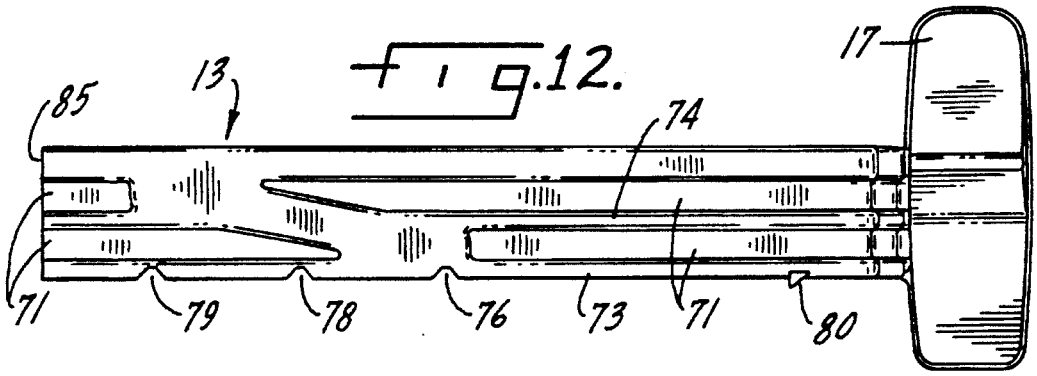
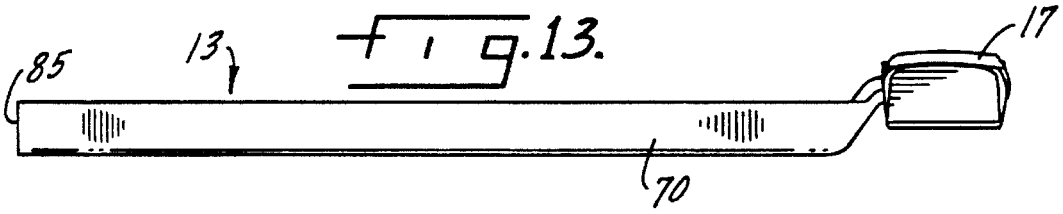
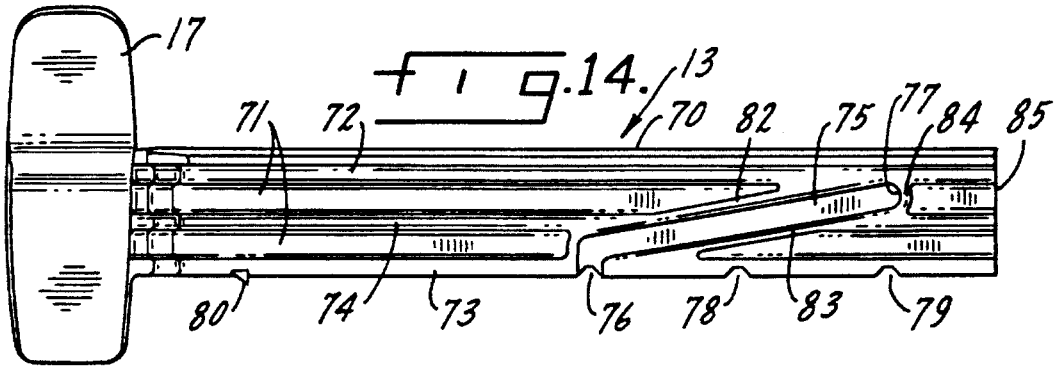
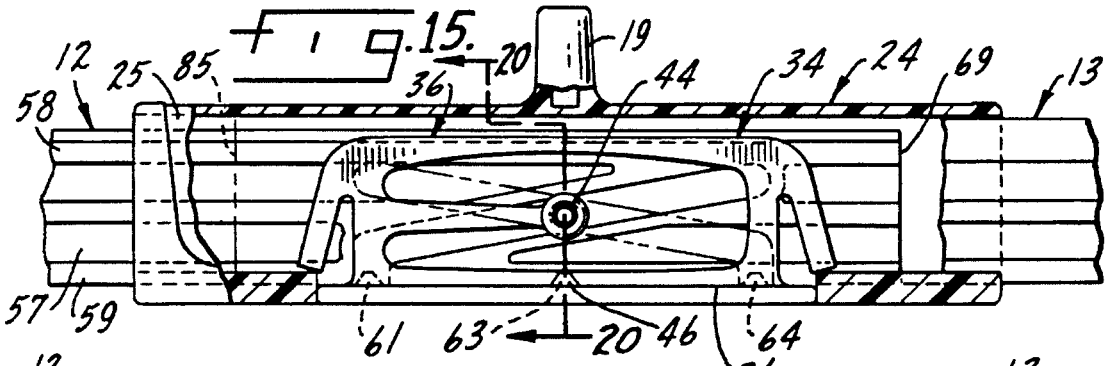
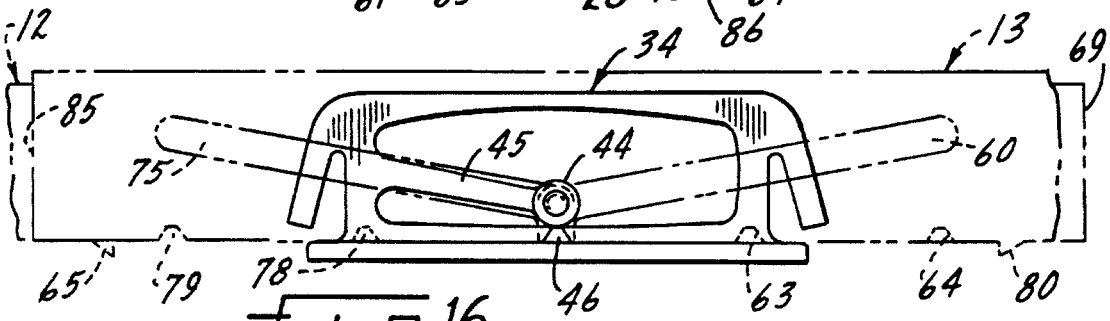
Fig.16.

SELF-CENTERING HANGER ASSEMBLY

This invention pertains generally to garment hangers and specifically to a garment hanger which is extensible and contractible lengthwise so that a single hanger fits all sizes of garments such as mens, boys, ladies and girls slacks and skirts, including big mens' slacks. Said hanger is further extensible and contractible in length by simple hand applied pulling and pushing pressure.

BACKGROUND OF THE INVENTION

Garment hanger manufacturers and users, of whom the latter are primarily clothing retailers, are today being forced by competitive pressures to lower the cost of hangers, both in a per part manufactured cost sense and in an administrative and accounting sense. Currently hanger manufacturers, and retailers, use several different sizes of what is essentially the same hanger design to accommodate the differences in sizes in garments which are to be displayed for the consumer. Thus a pair of girl's slacks or a girl's skirt is best presented on a hanger of relatively short length, such as about an eight inch hanger, a pair of mens' slacks or a ladies' skirt are best presented on a slightly larger hanger of about ten inches, and big mens' slacks require an even larger hanger, of, for example, about twelve inches. As a consequence the garment hanger manufacturer must produce three different sizes of hangers and the garment manufacturer must stock, and maintain an inventory watch on, three different sizes of hangers. At the retail level, hangers are often saved at the check out counter or cash register and thus either three separate bins must be maintained for each size of hanger, or, if a single bin is used, time consuming hand labor must be employed later to sort the different size hangers for re-use in the store, or, with increasing frequency at the present time, returned to a garment hanger manufacturer for recycling. Should the store participate in recycling, the cost and nuisance of inventorying three separate sizes of hangers accompanies the physical movement of the hangers from the store to the garment hanger manufacturer (who is the primary party responsible for recycling), and then to the garment manufacturer. The multiple handling steps involved in using and tracking three separate hanger sizes for the same hanger design is costly and time consuming.

If a single hanger could accommodate garments which today require three, or more, separate sizes of hangers, all of the foregoing processing steps and costs would be avoided. Indeed, if only a single size hanger could be used, the need to count and tally units of hangers could be entirely dispensed with; hangers could be handled in bulk by weight alone, the accuracy of a count being based on weight of a standard size shipping container would be entirely adequate for the inventory and cost accounting purposes of the garment manufacturer, the garment hanger manufacturer and the retailer.

SUMMARY OF THE INVENTION

Accordingly this invention pertains to a one size fits all hanger; that is, a single hanger which can, by easily applied hand pressure, be contracted or extended in length as desired over the entire range of lengths required to pack, ship and display all garments from girls' slacks and skirts up to and including big mens' slacks and other large garments.

The hanger is composed of essentially four pieces; i.e. two arms, a central housing, and a cam follower, the arms functioning as drivers for the follower so that as the arms are pushed toward or pulled away from one another they cooperate with the follower to drive the follower into or out of, in this instance, three discrete length positions.

Further, the operative components, or all components if desired, may be formed of conventional plastic material. The cam follower component is easily assembled to the drivers and, once assembled, the cam follower is positively restrained from separation from the drivers so that a reliable, easy to use, rugged hanger is provided to the garment manufacturer, the garment hanger manufacturer and the retail outlet.

BRIEF DESCRIPTION OF THE DRAWING

The invention is illustrated more or less diagrammatically in the accompanying drawing wherein:

FIG. 12 is a front elevation of the right adjustable arm taken to the same scale as FIG. 11;

FIG. 13 is a top plan view of the FIG. 12;

FIG. 14 is a rear view of the right adjustable arm of FIG. 12;

FIG. 15 is a partial sectional view through the central portion of the hanger with portions broken away for clarity;

FIG. 16 is a schematic illustration of the hanger in its shortest position illustrating particularly the position of the cam follower;

DETAILED DESCRIPTION OF THE INVENTION

Figure 1:
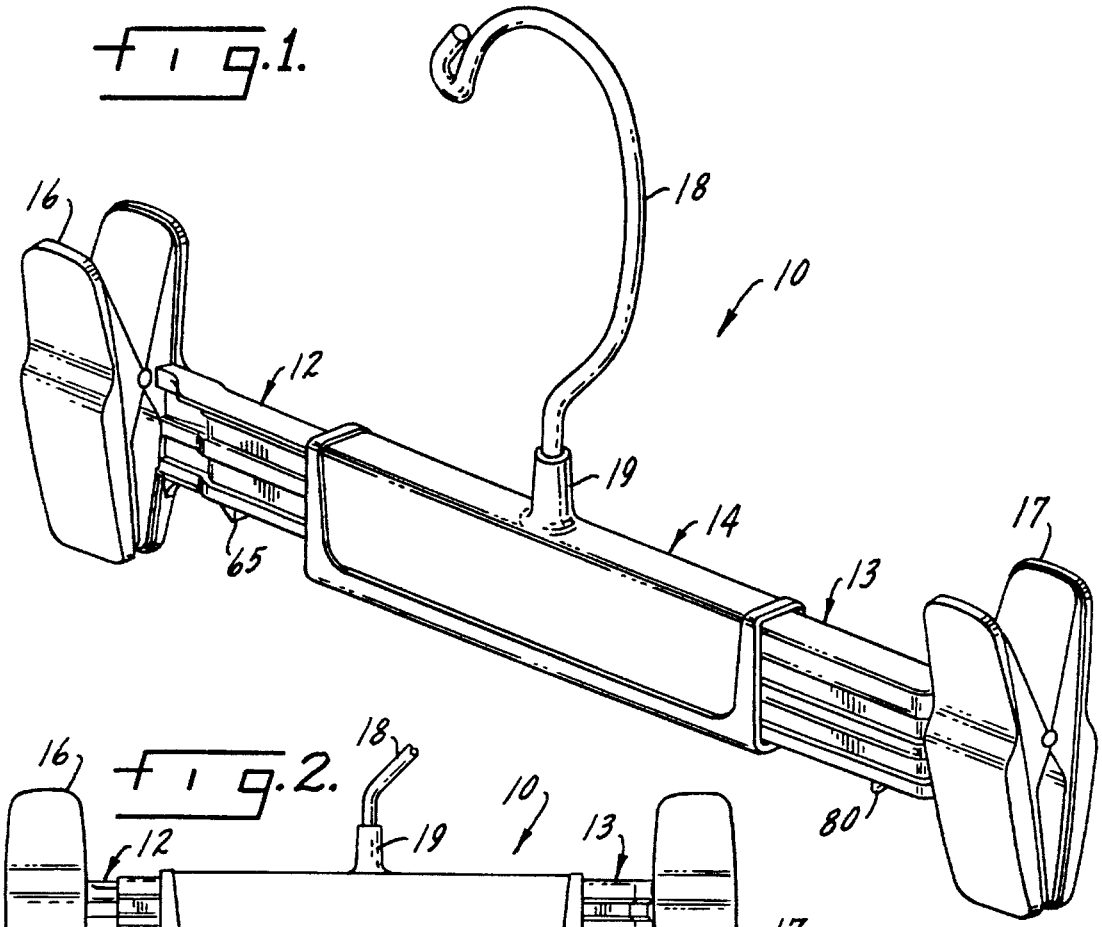
FIG. 1 is a perspective view of the adjustable hanger.

In the following description of the invention, like reference numerals will be used to refer to like or similar parts from Figure to Figure in the drawing.

The self-centering garment hanger of this invention is indicated generally at 10 in FIG. 1. Hanger 10 includes an extensible and retractable hanger bar consisting of a left arm, indicated generally at 12, a right arm, indicated generally at 13, and a center section, indicated generally at 14. A clamp 16 is located at the outer end of left arm 12 and a similar clamp 17 is located at the outer end or right arm 13. A hook, here a self-centering hook, is indicated at 18, the base of the hook projecting upwardly from and being rotatable with respect to a hook boss 19 which is integral with center section 14, also sometimes hereafter referred to as the center housing assembly.

Figure 2:
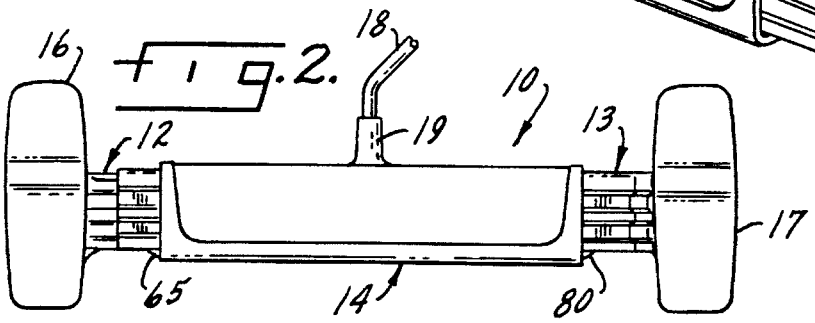
FIG. 2 is a front elevation of the adjustable hanger in its shortest position.

In FIG. 2 the hanger is shown in its shortest condition which may, for example, be on the order of about eight inches. To reach this condition a user has applied modest hand pressure to the ends of the hanger, such as on the clamps 16 and 17 in an inward or collapsing direction until an inner stop (to be later described) is reached. It will be noted that throughout this description "inward" or "inner" will be used to denote a direction pointing toward the vertical axis of the hook boss 19, and "outward" or "outer" will be used to denote a direction pointing away from the vertical axis of the hook boss 19.

Figure 3:
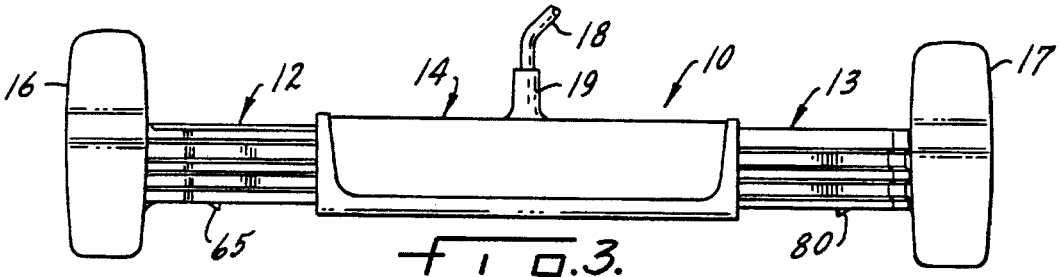
FIG. 3 is a front elevation of the adjustable hanger in its intermediate position.

In FIG. 3 the hanger is shown in its intermediate position which may, for example, be on the order of about ten inches. The hanger is moved to the FIG. 3 position by modest hand applied pressure on the left and right arms 12 and 13, as by grasping clamps 16 and 17, and pulling in outward directions if the hanger's prior position is the FIG. 2 position. Conversely, to move the hanger to the FIG. 3 position from its position of maximum length, hand applied pressure is exerted on arms 12 and 13, and/or clamps 16 and 17 to move the arms in inward directions.

Figure 4:
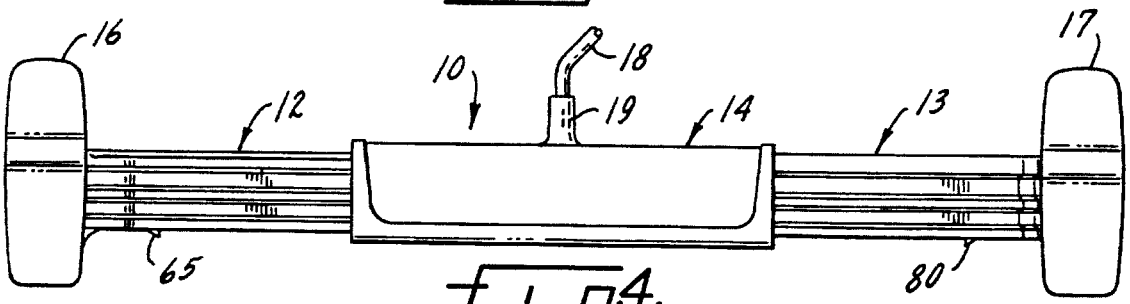
FIG. 4 is a front elevation of the adjustable hanger in its longest position.

In FIG. 4 the hanger is shown in its position of maximum extension which may, for example, be on the order of about twelve inches. To move the hanger components to the FIG. 4 position from either the FIG. 2 or FIG. 3 position, the user applies modest hand pressure to the arms 12 and 13, and/or the clamps 16 and 17, to move the arms in outward directions until a positive outer stop is reached.

Figure 5:
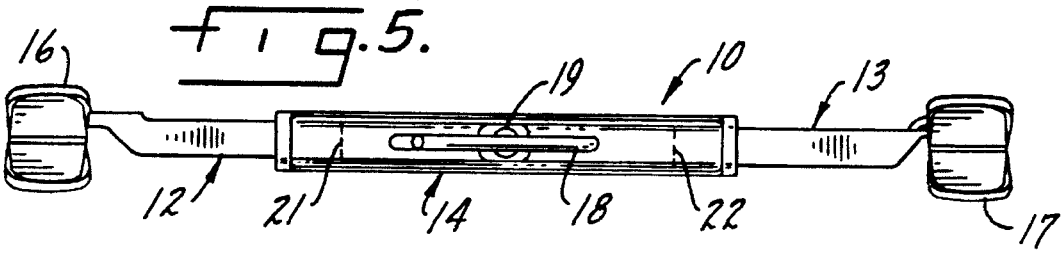
FIG. 5 is a top plan view of the intermediate position of the adjustable hanger.

In the top plan view of the intermediate position of FIG. 5 the position of the left end of right arm 13 is indicated by the dotted line 21, and the position of the right end of left arm 12 is indicated by the dotted line 22.

The center section 14 is illustrated best in FIGS. 6 through 9.

Figure 6:
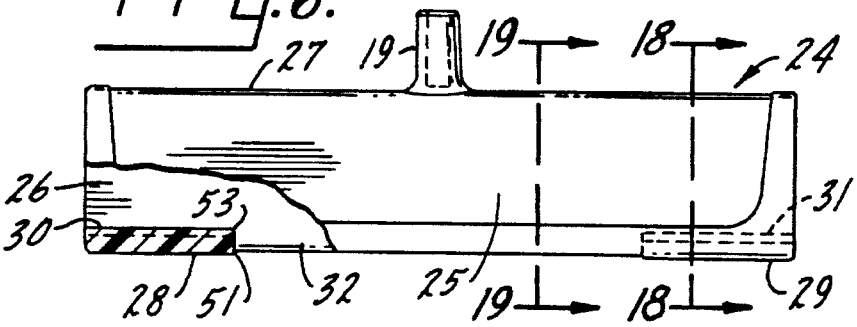
FIG. 6 is a front elevation of the outer housing of the center housing assembly with a portion broken away for clarity.
Figure 7:
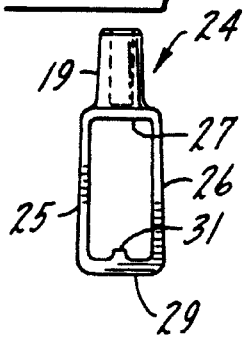
FIG. 7 is a right end view of FIG. 6.
Figure 18:
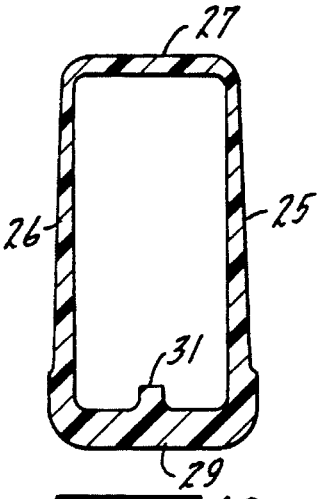
FIG. 18 is a section view taken substantially along the line 18—18 of FIG. 6.
Figure 19:
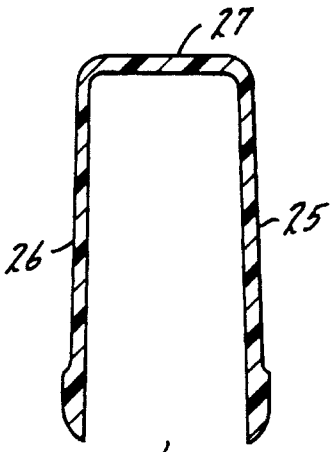
FIG. 19 is a section view taken substantially along the line 19—19 of FIG. 6.
Figure 20:
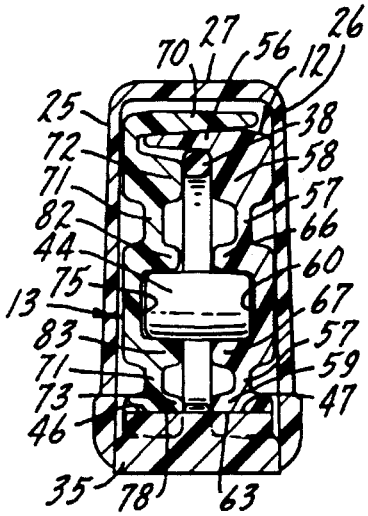
FIG. 20 is a section view taken substantially along the line 20—20 of FIG. 15.

The center section includes a box housing, indicated generally at 24, which includes front wall 25, rear wall 26 and top wall 27, see also FIGS. 18–20. The closed bottom portion of the housing is formed by two spans or struts 28, 29 at the left and right ends respectively of the housing. As best seen in FIG. 6 each of the struts extends inwardly from its associated end about one-quarter of the length of the housing, or, in this instance, a little less than one-quarter of the distance. The left strut has a rib 30, see also FIG. 21, which extends upwardly from its upper surface and runs the length of the left strut 28. The right strut has a rib 31 which extends upwardly from its upper surface and runs the length of the right strut. The contour of the right rib, and, in effect, both ribs can be best seen in FIG. 7. It will be seen that the bottom of the housing is open between the right end of left strut 28 and the left end of right strut 29 as indicated at 32. See also FIG. 19.

Figure 8:
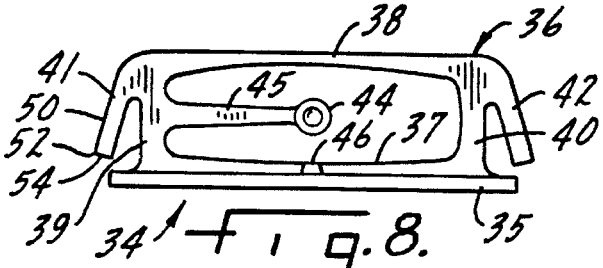
FIG. 8 is a front elevation of the cam follower element of the center housing assembly.
Figure 9:
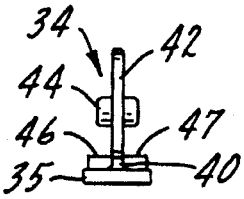
FIG. 9 is a right end view of FIG. 8.

The two arms 12, 13 and the cam and the cam follower element indicated generally at 34 in FIG. 8, form a camming system which makes possible the three length positions of the hanger. The use of the words "cam", "camming", and "camming action" refer to a movement system based on the application of a force associated with a physical object against an inclined plane, which application of force results in the movement of the object with respect to the plane in a direction different from the application of the force.

Figure 22:
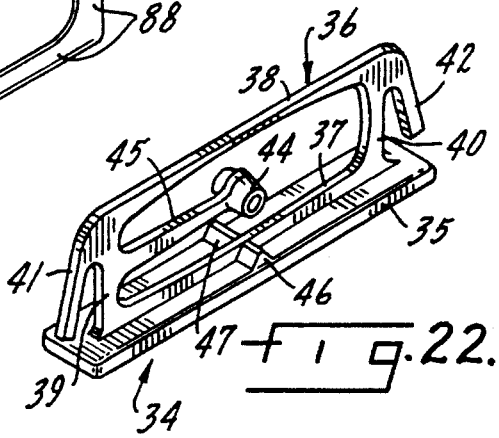
FIG. 22 is a perspective view of the cam follower element.

Cam follower element 34 includes a base plate 35 from which a generally quadrilaterally shaped camming frame, indicated generally at 36, extends upwardly. The camming frame 36 includes a bottom stringer 37, a top stringer 38, and left and right end members 39, 40 respectively. Left and right anchoring and locking members are indicated at 41, 42 respectively. The upper end of each locking member is formed integrally with the junction of the associated end and top stringer and, since the cam is formed from a resilient material, such as conventional plastic, the lower end of each locking member is capable of a slight inward and outward flexure as required. A cam follower is indicated generally at 44, the follower 44 being a short, stub shaft carried at the free end of cam arm 45 which projects inwardly from the inside of left end 39 of the cam frame 36. A front position locating cog or tooth is indicated at 46 and a rear locating cog or tooth at 37; see also FIG. 22.

To assemble the cam follower element 34 to the center section 14 the cam follower element 34 is moved upwardly into and through the opening 32 in the bottom of housing 24. Smooth edge 50 on left locking member 41 contacts the lower, inner edge 51 of strut 28 and the locking member 41 is deflected inwardly by reason of its resilient character. As soon as the left lower edge 52 of locking member 41 clears the upper, inner edge 53 of left strut 28, the left locking member 41 snaps outwardly (clockwise as viewed in FIGS. 8 and 15) until it comes to its normal, unstressed position of FIG. 8. In this position, which is also shown in FIG. 15, the lower edge 54 of locking member 41 snaps over and bears against the upper, inner edge 53 of strut 28, see FIG. 15, thereby locking the camming frame 36 into the housing 24.

Figure 10:
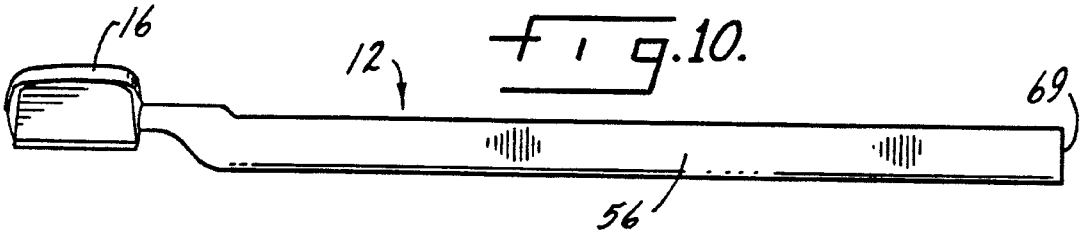
FIG. 10 is a top plan view of the left adjustable arm.
Figure 11:
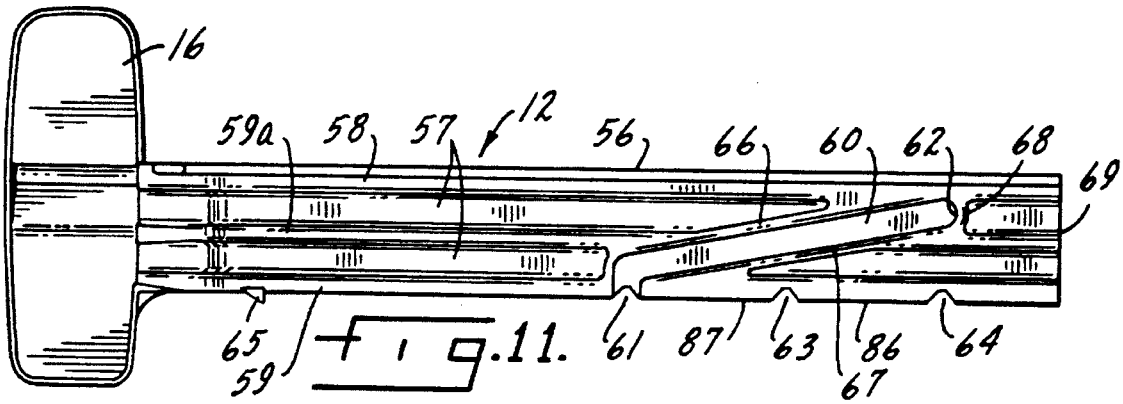
FIG. 11 is a front elevation of the left adjustable arm.

Referring now to FIGS. 10, 11 and 20 it will be seen that the left arm 12 includes a top flange 56 and a web 57. An upper cam steadying rib is indicated at 58, see particularly FIG. 20, and a lower cam steadying rib at 59, see also FIG. 20. A centrally located stiffening rib is indicated at **59*a*. A left arm follower track is indicated at 60, the track angling upwardly from an outer notch 61 in the bottom of the arm to a seat 62 at the upper right end of the track. The notch 61 corresponds to the shortest position of the hanger. A center notch is indicated at 63, the center notch establishing the intermediate position of the hanger. An inner notch is indicated at 64 the inner notch establishing the position of longest extension of the hanger. A left abutment stop is indicated at 65 projecting downwardly from the lower side of left arm 12, the abutment stop serving as a safety stop to limit the leftward movement of right arm 13 when the shortest position of the hanger bar is desired. From FIGS. 11 and 20 it will be noted that when notch 63 engages tooth 47, follower 44 will be in approximately the mid-position in track 60, said track being defined by side walls 66, 67 and a bight portion 68** there between.

Referring now to FIGS. 12, 13 and 14 it will be seen that right arm 13 includes a top flange 70 and a web 71. An upper cam steadying rib is indicated at 72, see particularly FIG. 20, and a lower cam steadying rib at 73, see also FIG. 20. A centrally disposed stiffening rib is indicated at 74. A right arm follower track is indicated at 75 in FIG. 14, the track angling upwardly from an outer notch 76 in the bottom of arm 13 to a seat 77 at the upper right end as viewed in FIG. 14. The notch 76 corresponds to the shortest position of the hanger. A center notch is indicated at 78, the center notch 78 establishing the intermediate position of the hanger. An inner notch is indicated at 79, the inner notch establishing the position of the longest extension of the hanger. A right abutment stop is indicated at 80 (to the left in FIG. 14 and to the right in FIG. 12) projecting downwardly from the lower side of arm 13, the abutment stop 80 serving as a safety stop to limit the rightward movement of left arm 12 when the shortest position of the hanger is desired. From FIGS. 14 and 20 it will be noted that when notch 78 engages tooth 47, follower 44 will be in approximately the mid-position in track 75, said track 75 being defined by side walls 82, 83 and a bight portion 84 there between at the upper end.

Referring now to FIG. 15 it will be noted that, for clarity, the left portion of right arm 13, as it appears in FIG. 12, has been omitted. The position of the left end of the right arm 13 when in the intermediate position is, for reference, indicated at 85 in FIG. 15. The bulk of the front wall 25 of housing 24 has been broken away to show the cam frame 36 in solid lines and the right end portion of left arm 12 in solid or, where covered by the cam frame 36, in dotted lines.

In the FIG. 15 position the hanger has been sized to its intermediate length which may, for example, be approximately 10 inches. In said intermediate position the left arm notch 63 has engaged the tooth 47, the dotted outline of the intermediate notch 63 being co-extensive with the outline of tooth 46. Cam follower 44 is in the intermediate position of FIGS. 8 and 22 in which it is deflected neither upwardly nor downwardly and hence is unstressed. It will be understood that as left arm 12 was moved to the right under hand applied pressure at its left end, and assuming the hanger started in its position of maximum extension, inner notch 64 rode up and over tooth 47 due to the inclined initially contacting surfaces on the left side of notch 64 and the left side of tooth 47. The bottom surface 86 between notches 63 and 64 then rode along the top of tooth 47 until notch 63 overlay tooth 46, at which point the notch 63 dropped over tooth 47 due to the downwardly acting pressures on left arm 12 resulting from the fairly close clearances between the box housing 24 and the arms 12 and 13, which clearances can be appreciated best from FIG. 15. When the notch 63 dropped onto tooth 47, an audible click was heard, and the resistance to further relative horizontal sliding movement between arms 12 and 13 immediately increased, which is a signal to the user that the intermediate position has been reached. If the user desires to position the hanger in the shortest position, a further rightward pull by the user on the left end of the left arm 12 will overcome the increased resistance to movement presented by the engagement of the notch 63 with tooth 47, and the bottom surface 87 of arm 12, see FIG. 11, between notch 61 and notch 63 will ride on tooth 47 until notch 61 is aligned with tooth 47 at which point the notch 61 will drop onto tooth 47.

Should too much pressure be exerted by the user in moving from notch 63 to notch 61, and the arm 12 consequently overshoot tooth 47, end 69 of arm 12 will very shortly strike stop 80 on right arm 13 so that the hanger will be prevented from jamming in a position of maximum contraction.

In the condition of maximum contraction; i.e.: when notch 61 engages cog 47 and notch 76 engages cog 46, cam arm 45 will be deflected downwardly to the position shown in FIG. 16. It will be understood that the sequence of events just described in connection with left arm 12 will occur simultaneously with respect to right arm 13. The cam follower 44 will follow the point of common overlap of the two follower tracks 60 and 75 and, since those tracks are inclined downwardly at the same, though reversed, angle as the hanger is contracted to its shortest position, the follower will be forced downwardly by the upper track sidewall 66 of left arm 12 and the upper track sidewall 82 of right arm 13 to the FIG. 16 position.

Figure 17:
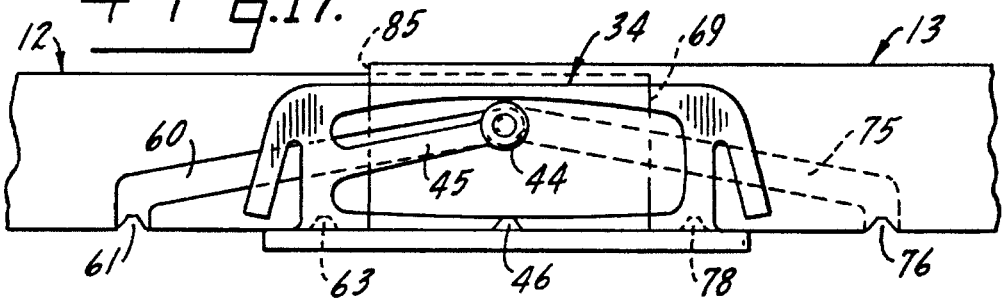
FIG. 17 is a schematic illustration of the hanger in its longest position.

Should the user desire that the hanger be extended to its maximum length starting from either the shortest or the intermediate length positions, a rightward pull or force is exerted on the right arm 13 and a leftward pull or force is exerted on the left arm 12 by the user to move the arms 12 and 13 away from one another. The notch engaging action with teeth 46, 47 will occur as above described. As the arms 12 and 13 move away from one another the cam arm 45 will be forced upwardly to the position of FIG. 17 by the lower track wall 67 of left arm 12 and the lower track wall 83 of right arm 13.

Figure 21:
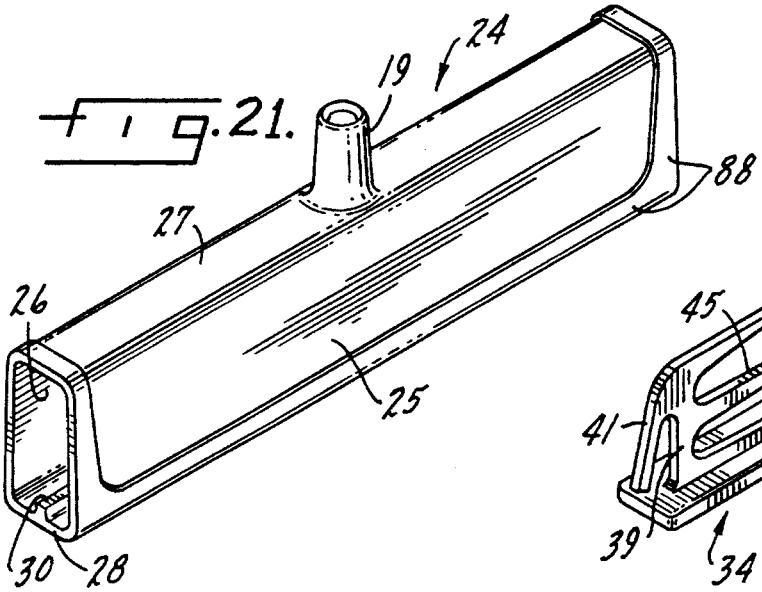
FIG. 21 is a perspective view of the outer housing.

From FIG. 21 it will be noted that an aesthetically pleasing design 88 may be applied to the outside surface of box housing 24. From FIG. 22 it will be noted that the most complex component of the garment hanger, the cam frame 36, may be easily fabricated by injection molding whereby it will be appreciated that the hanger may be formed from inexpensive material on a mass production basis.

Although a specific embodiment of the invention has been illustrated and described, it will be at once be apparent to those skilled in the art that variations and modifications may be made by those skilled in the art within the spirit and scope of the invention. Accordingly it is intended that the scope of the invention not be limited by the foregoing description, but rather solely by the scope of the hereafter claims when interpreted in light of the relevant prior art.

We claim:

1. A garment hanger which is extendible and contractible in response to a pressure applied by hand thereto, said garment hanger including first arm means having garment attachment means carried thereby, second arm means having garment attachment means carried thereby, retainer means for retaining the first arm means and the second arm means in operative relationship, one to the other, when the arm means are extended to a position of fixed maximum length and contracted to a position of fixed minimum length, and cam driver means, and cam follower means carried by the retainer means and cooperating with said cam driver means for producing a camming action extend or contract the arm means with respect to one another upon application of hand pressure to the arm means in extending or contracting directions.

2. The extendable and contractible garment hanger of claim 1 further characterized in that the first arm means and the second arm means are simultaneously extended or contracted in length with respect to one another upon application of hand pressure applied thereto.

3. The extendible and contractible garment hanger of claim 1 further characterized in that the cam driver means are carried by the arm means as the arm means are extended and contracted.

4. The extendible and contractible garment hanger of claim 3 further characterized in that the retainer means includes a stationary support structure with respect to which the arm means move in extending and contracting directions, said support structure mounting the cam follower means, said cam follower means being mounted to move up and down along a vertical line located between the outer ends of the first arm means and the second arm means.

5. The extendible and contractible garment hanger of claim 4 further including a plurality of position locating means which releasably grip the arm means at at least innermost and outermost positions with respect to one another, said innermost and outermost positions corresponding to the shortest and longest lengths of the garment hanger.

6. The extendable and contractible garment hanger of claim 4 further characterized in that the inner end portions of both the first arm means and the second arm means are received within said stationary support structure.

7. The extendable and contractible garment hanger of claim 6 further characterized in that the retainer means further includes a cam follower insert, said insert carrying the cam follower and being assembleable to the stationary support structure to form the retainer means, and locking means carried by the stationary support structure and the insert which mechanically resists separation of the insert from the stationary support structure following assembly of the insert to the stationary support structure.

8. The garment hanger which is extendable and contractible in length in response to pressure applied by hand thereto, said garment hanger including a right arm having garment securing means located at its outer end portion, a left arm having garment securing means located at its outer end portion, a housing within which the inner end portions of the right and left arms are received in sliding relationship, a cam driver channel in each of the right and left arms, each channel sloping upwardly toward the inner end of its respective arm at the same acute angle, though reversed, from one arm to the other when assembled, said channels being open toward each other, the lower end of each channel terminating in a cam follower entryway in the bottom of said arm, a cam follower insert which is insertable into the housing and, after insertion, is disposed between the cam driver channels in the right arm and left arm, a cam follower carried by an elongated flexible extension arm which extends from the insert, said extension arm being located between the two opposed inner end portions of the right arm and left arm, said cam follower being of a size capable of being received within the aligned entryways of the right arm and left arm, and thence movable in a vertical direction as the arms are extended with respect to one another, and hook means extending from the housing for hanging the garment hanger from support means.

9. The garment hanger of claim 8 further including cog means carried by the cam follower insert, and a plurality of notches in the bottom of each arm, each notch being of a size to snugly fit over said cog means, at least one notch in the bottom of each arm being co-extensive with the entryway in its arm and at least a second notch in the bottom of each arm near the inner end of the arm, said first notch fixing the minimum length of the garment hanger when the cog means engages therewith, said second notch fixing the maximum length of the garment hanger when the cog means engages therewith.

10. The garment hanger of claim 9 further characterized in that the housing and arms are composed of a flexible material whereby a snug, sliding relationship exists between the housing and the arms that results in a seating force being continuously exerted on the arms in a direction to force the arms to engage the cog means whenever the notches in the bottoms of the arms are not in engagement with the cog means carried by the insert.

11. The garment hanger of claim 10 further including mechanical stop means extending downwardly from the bottom of each arm at a location which precludes further relative movement of the arms in a contracting direction past the notch at the inner end of each arm.

12. A garment hanger which is extendible and contractible in response to a pressure applied by hand thereto, said garment hanger including first arm means having garment attachment means carried thereby, second arm means having garment attachment means carried thereby, retainer means for retaining the first arm means and the second arm means in operative relationship, one to the other, when the arm means are extended to a position of maximum length and contracted to a position of minimum length, and all locations therebetween, cam driver means, and cam follower means carried by the retainer means and the arm means for extending or contracting the arm means with respect to one another upon application of hand pressure to the arm means in extending or contracting directions, the cam driver means being carried by the arm means as the arm means are extended and contracted, the retainer means including a stationary support structure with respect to which the arm means move in extending and contracting directions, said support structure mounting the cam follower means, said cam follower means being mounted to move up and down along a vertical line located between the outer ends of the first arm means and the second arm means, a plurality of position locating means which releasably grip the arm means at the least innermost and outermost positions with respect to one another, said innermost and outermost positions corresponding to the shortest and longest lengths of the garment hanger, the inner end portions of both the first arm means and the second arm means being received within said stationary support structure, the retainer means further including a cam follower insert, said insert carrying the cam follower and being assembleable to the stationary support structure to form the retainer means, and locking means carried by the stationary support structure and the insert which mechanically resists separation of the insert from the stationary support structure following assembly of the insert to the stationary support structure.

13. The extendible and retractible garment hanger of claim 12 further characterized firstly, in that the cam follower means consists of a cam follower, said cam follower being carried by a flexible arm which is anchored to the cam follower insert, and secondly, in that the cam driver means are angled channels which are contoured to receive the cam follower and extend from an opening in the bottoms of the first arm means and second arm means to, for each channel, a terminus near the upper edge of each respective channel associated arm means, said flexible arm being of a length sufficient to enable the cam follower to move from the openings in the bottom of the first arm means and second arm means upwardly to the terminus of each channel in the first arm means and second arm means.

* * * * *